United States Patent [19]

Eguchi

[11] Patent Number: 4,739,703

[45] Date of Patent: Apr. 26, 1988

[54] INKING APPARATUS FOR PRINTING PRESS WITH VIBRATING FORM ROLLER

[75] Inventor: Satoru Eguchi, Ibaraki, Japan

[73] Assignee: Komori Printing Machinery Co., Ltd., Ibaraki, Japan

[21] Appl. No.: 114,636

[22] Filed: Oct. 28, 1987

[51] Int. Cl.[4] ..... B41F 31/14; B41L 27/16

[52] U.S. Cl. ..... 101/349; 101/DIG. 14

[58] Field of Search ..... 101/348, 349, 350, 351, 101/352, DIG. 14, 205–209, 148

[56] References Cited

U.S. PATENT DOCUMENTS

| | | | |
|---|---|---|---|
| 1,027,384 | 5/1912 | Green | 101/DIG. 14 |
| 1,533,062 | 4/1925 | Daane | 101/DIG. 14 |
| 4,546,701 | 10/1985 | Junghans | 101/349 |
| 4,672,894 | 6/1987 | Hardin | 101/348 |

FOREIGN PATENT DOCUMENTS 60-101049 of 1985 Japan .

*Primary Examiner*—J. Reed Fisher

*Attorney, Agent, or Firm*—Perman & Green

[57] ABSTRACT

A inking apparatus includes form rollers brought into rolling contact with vibrating rollers. Each form roller includes a rotatable roller shaft whose axial movement is limited, and a roller body fitted on the roller shaft. Right and left vibration stroke adjusting screws are threadably engaged with male screws at both ends of the roller shaft and are movable in an axial direction of the roller shaft. Compression coil springs are compressed between the right vibration stroke adjusting screw and one of both the ends of the roller body and between the left vibration stroke adjusting screw and the other end of the both ends of the roller body. The compression coil springs define a vibration stroke by positions where the compression coil springs are completely compressed.

3 Claims, 2 Drawing Sheets

INKING APPARATUS FOR PRINTING PRESS WITH VIBRATING FORM ROLLER

BACKGROUND OF THE INVENTION

The present invention relates to an inking apparatus for a printing press, wherein an ink is applied to a plate surface.

A conventional printing press inking apparatus for applying an ink to a surface of a plate attached to a plate cylinder comprises an ink fountain for storing an ink and a roller group for transferring an ink flowed out from the ink fountain and for uniformly distributing the ink in all directions. The ink transferred to vibrating rollers located near the end of the roller group is applied to the plate surface through form rollers. Each vibrating roller in the inking apparatus is rotated and axially vibrated by a motor. Each form roller is supported by shaft end portions of the corresponding vibrating roller through arms and is in contact with the vibrating roller. The form roller can be brought into contact with or separated from the plate surface by swinging the arms. The form roller transfers the ink to the plate surface while being brought into contact with the vibrating roller and the plate surface. The form roller is rotated by gear coupling arranged with the vibrating roller and is axially vibrated by a grooved cam arranged at the end portion thereof.

Japanese Patent Laid-Open (Kokai) No. 60-101049 describes a construction wherein a form roller is not positively driven but is rotated and axially vibrated by friction between the vibrating and form rollers.

Vibrations of the form roller aim at distributing local picture remaining portions (a so-called ghost) of the plate surface. When a vibration stroke of the form roller is excessively long, durability of an inking mechanism and printing on the plate surface are degraded. The vibration stroke is preferably minimized. Therefore, the vibration stroke is preferably adjusted to a given ghost level.

In the form rollers in the conventional inking apparatuses described above, the mechanism with the grooved cam and the mechanism utilizing friction between the vibrating and form rollers cannot adjust the vibration strokes. As a result, the durability of the mechanisms cannot be improved. In particular, the mechanism with the grooved cam cannot stop axial vibration. In order to improve the durability of the mechanism, vibrating and nonvibrating rollers are prepared and selectively used for types of printed matters. For this reason, a long preparation time including a nip adjustment time is required, and therefore productivity is degraded and a large amount of paper is wasted.

SUMMARY OF THE INVENTION

It is an object of the present invention to provide an inking apparatus for a printing press, wherein productivity and quality of printed matters can be greatly improved.

It is another object of the present invention to provide an inking apparatus for a printing press, wherein durability of an inking mechanism can be greatly improved.

It is still another object of the present invention to provide an inking apparatus for a printing press, wherein waste of paper is minimized and low-noise operation can be performed.

In order to achieve the above objects of the present invention, there is provided an inking apparatus for a printing press, comprising: vibrating rollers rotated by a driving source, which are axially vibrated; form rollers brought into rolling contact with the vibrating rollers, each of the form rollers being provided with a rotatable roller shaft whose axial movement is limited, and a roller body fitted on the roller shaft; right and left vibration stroke adjusting screws threadably engaged with male screws at both ends of the roller shaft and movable in an axial direction of the roller shaft; and compression coils springs compressed between the right vibration stroke adjusting screw and one of the both ends of the roller body and between the left vibration stroke adjusting screw and the other end of the both ends of the roller body, the compression coil springs being adapted to define a vibration stroke by positions where the compression coil springs are completely compressed.

When the vibrating rollers are rotated and axially vibrated, the corresponding form rollers are rotated and axially moved accordingly. In this case, axial vibration of each roller body is limited by positions where right and left compression coil springs are completely compressed. A vibration stroke can be determined by adjustment positions of the vibration adjusting screws.

BRIEF DESCRIPTION OF THE DRAWINGS

FIGS. 1 and 2 show an embodiment of an inking apparatus for a printing press according to the present invention, in which:

FIG. 1 is a partially cutaway plan view of an end portion of each form roller; and FIG. 2 is a schematic view showing the cylinder layout in a double side rotary press which employs the present invention.

DESCRIPTION OF THE PREFERRED EMBODIMENT

Figure 1:
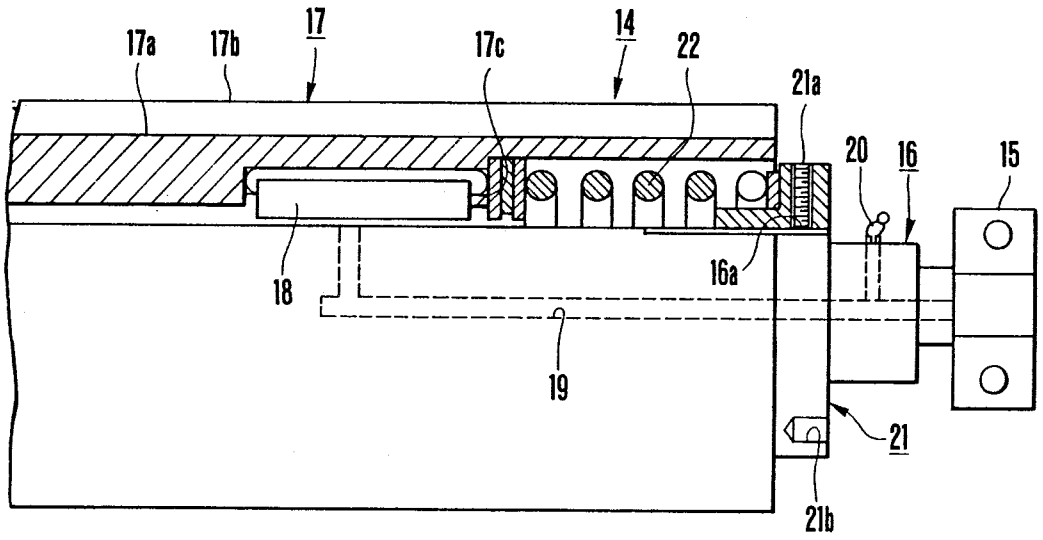
Figure 2:
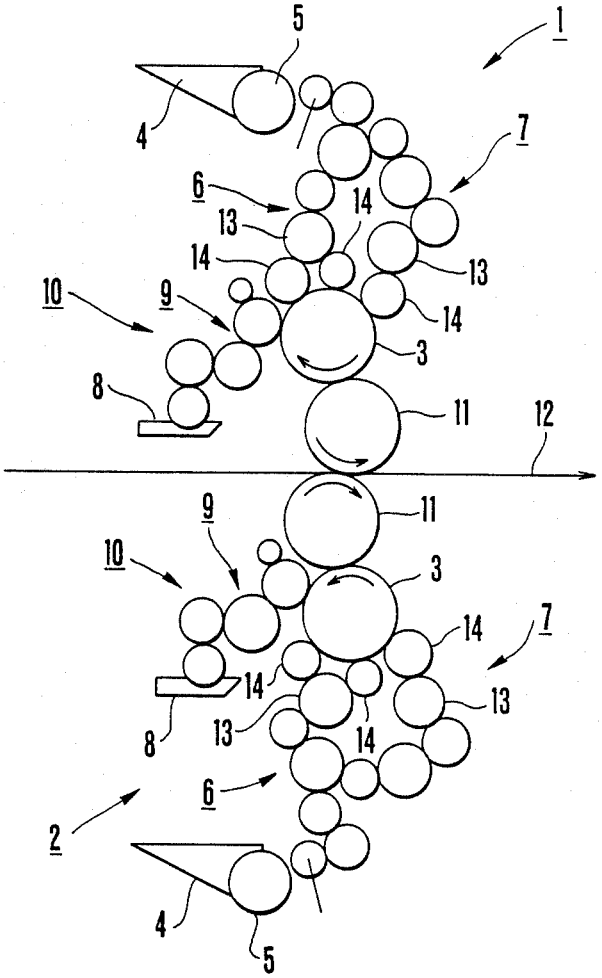

FIGS. 1 and 2 show an inking apparatus according to an embodiment of the present invention. Referring to FIGS. 1 and 2, upper and lower printing apparatuses 1 and 2 in a printing unit include plate cylinders 3 to which the corresponding plates are attached, respectively. An inking apparatus 7 and a dampening apparatus 10 are provided to each plate cylinder 3. The inking apparatus 7 comprises an ink fountain 4 for storing an ink and a roller group 6 including an ink fountain roller 5. The dampening apparatus 10 comprises a water fountain 8 and a plurality of rollers 9. Reference numerals 11 denote blanket cylinders which are brought into rolling contact with blanket cylinders 3, respectively. The blanket cylinders 11 are also brought into rolling contact with each other. Blankets are wound around the blanket cylinders 11, respectively. Reference numeral 12 denotes a web clamped between the upper and lower blanket cylinders 11.

The roller group 6 in each inking apparatus 7 in the printing apparatuses 1 and 2 includes two vibrating rollers 13 and three form rollers 14 near the end of the roller group 6 on the side of the corresponding plate cylinder 3. Each vibrating roller 13 is supported by the right and left frames, driven by a motor, and axially vibrated by a vibrating mechanism at a vibration amplitude and a predetermined period. The vibrating mechanism is arranged at the end of a roller shaft. Arms (not shown) are fixed to both ends of the shaft of the vibrating roller 13. A roller shaft 16 for constituting each form roller 14 is rotatably supported by bearings 15 arranged in free end portions of the arms. A stepped portion of the roller shaft 16 prevents axial movement thereof. A roller body 17 for constituting each form roller 14 together with the roller shaft 16 is fitted on the roller shaft 16 through a plurality of slide bearings 18. The roller body 17 is rotatably supported by the roller shaft 16 so as to be reciprocal in the axial direction thereof. It should be noted that the roller body may be slidable in only the axial direction. The roller body 17 comprises a metal pipe 17*a* and rubber 17*b* coated on the metal pipe 17*a*. With the above construction, when the arms are swung, each form roller 14 is brought into contact with the corresponding vibrating roller 13 and the corresponding plate cylinder 3. The form roller 14 is therefore rotated and axially vibrated by friction with the corresponding vibrating roller 13. Reference numeral 19 denotes a lubricant hole for the slide bearing 18; and 20, a grease cup.

A mechanism is arranged on the form roller 14 to define the vibration limit and adjust the vibration stroke. A flanged vibration stroke adjusting screw 21 is threadably engaged with a male screw 16*a* formed at each end of the roller shaft 16. When the flanged vibration stroke adjusting screw 21 is turned with respect to the roller shaft 16, it is displaced inward or outward along the corresponding male screw 16*a*. Reference numeral 21*a* denotes a fastening screw for fixing the corresponding adjusting screw 21 at the adjusted position; and 21*b*, a hole for inserting a wrench for turning the fastening screw 21*a*. A compression coil spring 22 is compressed between the flange of each vibration stroke adjusting screw 21 and a bottom surface 17*c* defining the hole in the roller body 17. When the roller body 17 is axially vibrated, the right and left compression coil springs 22 at both end portions of the roller shaft 16 are alternately compressed. An axial vibration stroke is defined by positions where the compression coil springs 22 are completely compressed. When the right and left vibration stroke adjusting screws 21 are fastened, the right and left compression coil springs 22 are compressed, so that the axial vibration stroke can be reduced.

The operation of the printing apparatus with the above arrangement will be described below.

An ink and dampening water are respectively filled in the ink and water fountains 4 and 8, and the printing press is started. The inks flowed out from the ink fountains 4 are distributed while they are transferred in the roller groups 6 in the inking apparatuses. The inks are uniformly distributed and applied to the plate surfaces by the pluralities of form rollers 14, respectively. Meanwhile, dampening water sucked from the water fountains 8 is uniformly distributed by the rollers 9 and is supplied to the plate surfaces. Images are formed on the upper and lower plate surfaces by the supplied inks and water. These images are transferred to the blanket cylinders 11 and the upper and lower surfaces of the web, thus performing double side printing.

During printing, the vibrating rollers 13 are rotated and axially vibrated by the motor, and the roller bodies 17 of the corresponding form rollers 14 are rotated and axially vibrated on the corresponding roller shafts 16 by friction with the vibrating rollers 13. The roller bodies 17 are axially vibrated by alternate compression of the right and left compression coil springs 22. Impacts acting on the stroke ends can be damped. When each compression coil spring 22 is completely compressed, further movement of the corresponding roller body 17 is inhibited, and thereafter only the vibrating roller 13 is axially vibrated. In other words, the axial vibration stroke of each roller body 17 is prevented by the corresponding right and left compression coil springs 22. In order to increase the vibration stroke, the screws 21*a* are loosened and the wrenches are inserted in the holes 21*b*. The vibration stroke adjusting screws 21 are turned in the loosening directions, and the corresponding compression coil springs 22 are elongated, thereby increasing the vibration stroke of the roller body 17. However, when the vibration stroke adjusting screws 21 are fastened, the vibration stroke can be reduced. In this manner, the vibration stroke can be arbitrarily adjusted. When the vibration stroke of each form roller 14 is adjusted according to an image of the printed matter, the vibration stroke of the form roller 14 is changed with respect to the plate surface, thereby distributing the ghost according to the type of image.

According to the present invention as is apparent from the above description, in the inking apparatus for a printing press, each roller body is mounted on the corresponding roller shaft whose rotational movement is allowed but axial movement is prevented, thereby constituting the form roller. The vibration stroke adjusting screws are threadably fitted on the male screws at both ends of the roller shafts. Compression coil springs are compressed between the right vibration stroke adjusting screw and the corresponding end face of the roller body and between the left vibration stroke adjusting screw and the corresponding end face thereof. When the vibrating roller is rotated and axially vibrated, the corresponding form roller is rotated and axially vibrated. In this case, the vibration stroke of the roller body is defined by positions where the compression coil springs are completely compressed. In addition, the vibration stroke is also arbitrarily adjusted by turning of the vibration stroke adjusting screw. Therefore, the ghost can be properly distributed according to the type of printed matter, thereby greatly improving the quality of printed matters. Furthermore, the vibration stroke can be set to a required minimum stroke, and the durability of the mechanism and printing on the plate surface can be improved. Furthermore, the impacts at the stroke ends corresponding to both ends of the roller body can be absorbed by the compression coil springs. Therefore, waste of paper can be reduced and low-noise operation can be performed.

What is claimed is:

1. An inking apparatus for a printing press, comprising:

vibrating rollers rotated by a driving source, which are axially vibrated;

form rollers brought into rolling contact with said vibrating rollers, each of said form rollers being provided with a rotatable roller shaft whose axial movement is limited, and a roller body fitted on said roller shaft;

right and left vibration stroke adjusting screws threadably engaged with male screws at both ends of said roller shaft and movable in an axial direction of said roller shaft; and compression coils springs compressed between said right vibration stroke adjusting screw and one of said both ends of said roller body and between said left vibration stroke adjusting screw and the other end of said both ends of said roller body, said compression coil springs being adapted to define a vibration stroke by positions where said compression coil springs are completely compressed.

2. An apparatus according to claim 1, wherein said vibration stroke adjusting screws respectively have holes for receiving wrenches for adjusting compression of said compression coil springs and hence the vibration stroke.

3. An apparatus according to claim 1, wherein said vibration stroke adjusting screws integrally include flanges for stopping said compression coil springs.

* * * * *